US007263300B2

(12) United States Patent
Ishii et al.

(10) Patent No.: US 7,263,300 B2
(45) Date of Patent: Aug. 28, 2007

(54) IMAGE FORMING DEVICE THAT PROVIDES STATUS OF DEVELOPER

(75) Inventors: Masahiro Ishii, Nagoya (JP); Mitsuru Horinoe, Chita-gun (JP); Koji Aoyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 119 days.

(21) Appl. No.: 10/603,861

(22) Filed: Jun. 26, 2003

(65) Prior Publication Data

US 2004/0086286 A1 May 6, 2004

(30) Foreign Application Priority Data

Jun. 26, 2002 (JP) ..... 2002-185843

(51) Int. Cl.
*G03G 15/08* (2006.01)

(52) U.S. Cl. ..... 399/27

(58) Field of Classification Search ..... 399/27, 399/67, 70

See application file for complete search history.

(56) References Cited

U.S. PATENT DOCUMENTS 5,040,031 A * 8/1991 Hayashi ..... 358/1.15
6,006,050 A * 12/1999 Watanabe et al. ..... 399/58
6,668,141 B2 12/2003 Kojima et al.
2003/0035656 A1 2/2003 Yamamoto et al.
2003/0175039 A1 9/2003 Yamamoto et al.

FOREIGN PATENT DOCUMENTS

| | | | |
|---|---|---|---|
| JP | B2 2583993 | | 11/1996 |
| JP | B2 2776440 | | 5/1998 |
| JP | 10-221944 | | 8/1998 |
| JP | 2000075613 A | * | 3/2000 |
| JP | 2001-100508 | | 4/2001 |
| JP | 2001-175067 | | 6/2001 |
| JP | B2 3198806 | | 6/2001 |
| JP | 2001-201988 | | 7/2001 |
| JP | 2002-2091152 | | 3/2002 |

* cited by examiner

*Primary Examiner*—Quana Grainger
(74) *Attorney, Agent, or Firm*—Oliff & Berridge, PLC

(57) ABSTRACT

After a laser printer has been inactive for a long period of time, the CPU in the laser printer compares the remaining toner status determined based on a detection by a toner sensor during a warm-up operation prior for performing a printing operation and the last remaining toner status that was determined during a printing operation and that is stored in memory, and displays the larger of the two.

16 Claims, 9 Drawing Sheets

1

| EX. | PREVIOUS STATUS | CURRENT STATUS | DISPLAY STATUS |
|---|---|---|---|
| 1 | EMPTY | EMPTY | EMPTY |
| 2 | EMPTY | LOW | LOW |
| 3 | EMPTY | FULL | FULL |
| 4 | LOW | EMPTY | LOW |
| 5 | LOW | LOW | LOW |
| 6 | LOW | FULL | FULL |
| 7 | FULL | EMPTY | FULL |
| 8 | FULL | LOW | FULL |
| 9 | FULL | FULL | FULL |

IMAGE FORMING DEVICE THAT PROVIDES STATUS OF DEVELOPER

BACKGROUND OF THE INVENTION

1. Field of the Invention

The present invention relates to an image forming device, such as a laser printer.

2. Description of the Related Art

Image forming devices such as electrophotographic laser printers are well known in the art. A developer cartridge accommodating toner can be detachably mounted in this type of image forming device.

The developer cartridge includes a toner compartment and a developing section. The toner compartment is filled with toner and includes an agitator that can be driven to rotate. The developing section includes a supplying roller, a developing roller, and a thickness regulating blade. The supplying roller and the developing roller are juxtaposed and in contact with each other. The thickness regulating blade applies pressure to the surface of the developing roller.

When the developer cartridge is mounted in the laser printer, motive power from the laser printer is transferred to the developer cartridge through a gear train. As a result, the agitator rotates and conveys toner from the toner compartment to the developing section. Also, the supplying roller to supply the toner onto the developing roller. The toner is tribocharged between the supplying roller and the developing roller at this time. Further, as the developing roller rotates, toner on the surface of the developing roller passes between the thickness regulating blade and the developing roller and is regulated to a layer of uniform thickness on the surface of the developing roller.

The developer cartridge is disposed in the laser printer with the developing roller in opposition with a photosensitive drum of the laser printer. The photosensitive drum is formed on its surface with an electrostatic latent image. When rotation of the developing roller brings the toner on the surface of the developing roller into contact with the photosensitive drum, the toner moves onto and develops the electrostatic latent image into a toner image. The toner image is then transferred onto the surface of a sheet by operation of a transfer roller.

Conventionally this type of image forming device includes a toner sensor for detecting the amount of toner remaining in the toner compartment.

Normally the toner sensor is an optical sensor that includes a light-emitting element and a light-receiving element. Also, light-transmissive windows are provided in opposite walls of the toner compartment. The light-emitting element and light-receiving element are positioned one on the outside of each transmissive wall so as to face each other through the light-transmissive windows.

The toner sensor outputs a light detection signal to a CPU in the laser printer each time the light-receiving element receives light emitted from the light-emitting element. The CPU determines the amount of toner remaining in the toner compartment based on the percentage of light received by the light-receiving element. The CPU then selectively displays data indicating the remaining toner status, such as "full state," "low state," "empty state," on a display panel of the laser printer.

SUMMARY OF THE INVENTION

However, this configuration sometimes does not accurately detect the amount of toner in the toner compartment.

In such cases, the remaining toner status displayed on the display can be incorrect. For example, the amount of toner can be detected inaccurately during a warm-up operation. A warm-up operation is performed before a new image forming operation is performed after the image forming device has been turned off or otherwise inactive for a long period of time. During the warm-up operation, the agitator, developing roller are driven for a certain duration of time. However, the toner in the toner compartment is in a settled condition after the image forming device is inactive for a long period of time, so the percentage of light received by the light-receiving element is larger than normal during a warm-up operation. As a result, an "empty state" may be displayed on the display device when in fact a "low states" should be displayed, or a "low state" may be displayed when a "full state" should be displayed.

It is an object of the present invention to provide an image forming device capable of accurately displaying the status of remaining developer when the image forming device is used after a long period of inactivity.

In order to achieve the above-described object, an image forming device according to the present invention includes a developer container, a developer amount detector, a display, a memory, and a controller.

The developer container accommodates developer. The developer amount detector detects a remaining developer amount accommodated in the developer container. The memory stores data representing a remaining developer amount detected by the developer amount detector. The controller performs a warm-up operation and, during the warm-up operation, performs a calculation based on the remaining developer amount detected by the developer amount detector and on the data stored in the memory and controls to display a status of the remaining developer amount on the display based on results of the calculation.

An image forming device according to another aspect of the present invention is for forming a developer image on a recording medium and includes a developer container, a developer amount detector, a display, a memory, and a controller.

The developer container accommodates developer. The developer amount detector detects a remaining developer amount accommodated in the developer container. The memory stores data representing a remaining developer amount detected by the developer amount detector. The controller compares the remaining developer amount detected by the developer amount detector with the remaining developer amount indicated by the data stored in the memory and controls to display a larger of the remaining developer amount detected by the developer amount detector and the remaining developer amount indicated by the data stored in the memory.

DESCRIPTION OF THE EMBODIMENT

Figure 1:
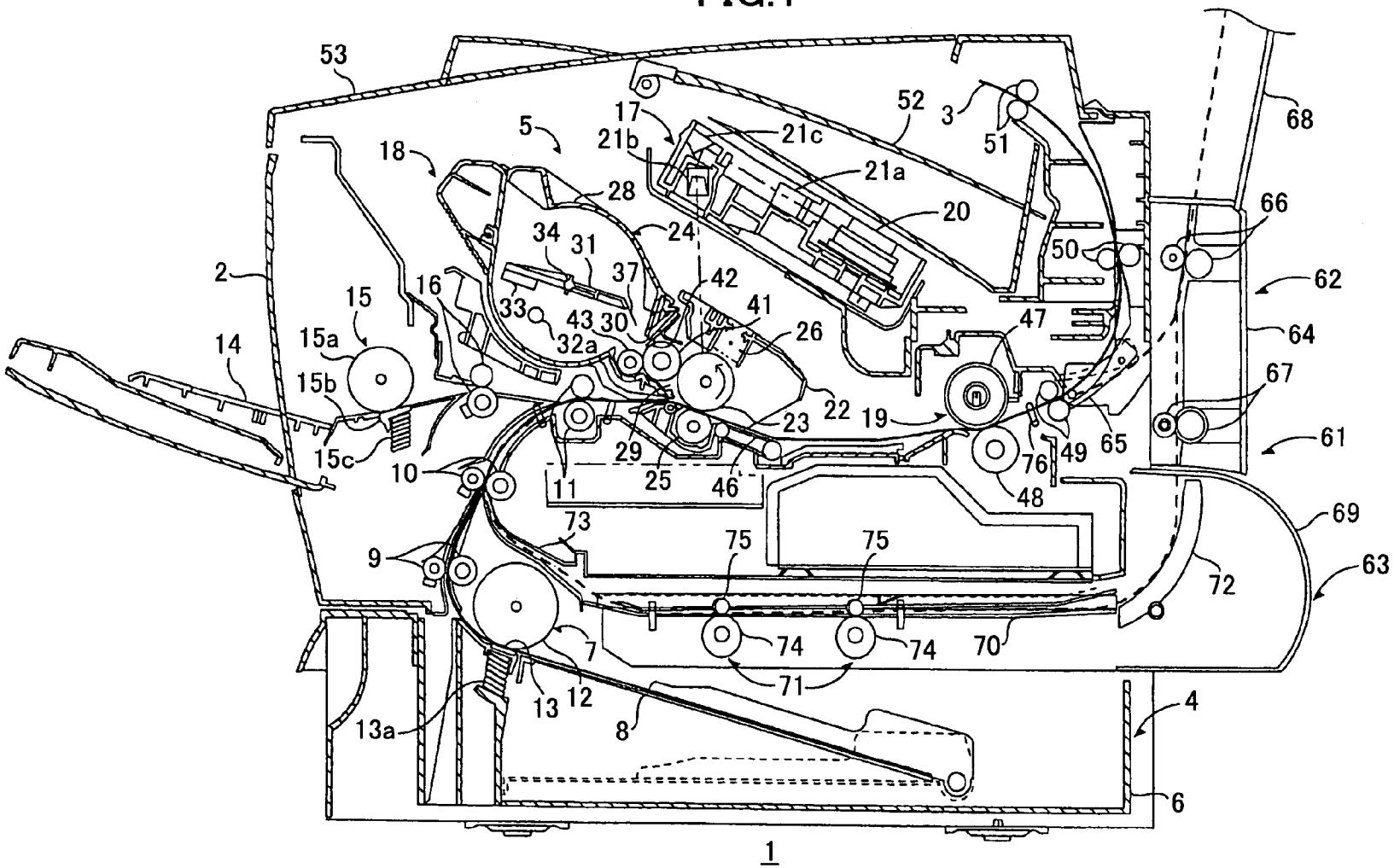
FIG. 1 is a side cross-sectional view showing relevant components of a laser printer according to an embodiment of the present invention.

An image forming device according to an embodiment of the present invention will be described while referring to the accompanying drawings. FIG. 1 is a side cross-sectional view showing relevant components of an electrophotographic laser printer 1 according to the embodiment.

As shown in FIG. 1, the laser printer 1 includes a feeder unit 4 for supplying sheets 3 of paper, an image forming unit 5 for forming images on the supplied sheets 3, and a main casing 2 accommodating the feeder unit 4 and image forming unit 5.

The feeder unit 4 is disposed in the bottom section of the main casing 2 and includes a feed tray 6 detachably mounted in the feeder unit 4, a paper supply mechanism 7 provided on one side end of the feed tray 6, a paper pressing plate 8 disposed in the feed tray 6, a pair of first conveying rollers 9 and a pair of second conveying rollers 10 provided downstream from the paper supply mechanism 7 in the direction that the sheets 3 are conveyed (hereinafter upstream or downstream in the conveying direction of the sheets 3 will be abbreviated as simply "upstream" or "downstream"), and registration rollers 11 provided downstream from the conveying rollers 9 and 10.

The feed tray 6 is shaped like an open-top box and can accommodating a stack of sheets 3. The feed tray 6 can be slid horizontally to be removed from or inserted into the bottom section of the main casing 2.

The paper supply mechanism 7 includes a feed roller 12, and a separating pad 13 in confrontation with the feed roller 12. A spring 13*a* is disposed on the underside of the separating pad 13. Urging force of the spring 13*a* presses the separating pad 13 against the feed roller 12.

Sheets 3 are stacked on the paper pressing plate 8. The paper pressing plate 8 is pivotably supported on the end farthest from the feed roller 12, so that the end nearest the feed roller 12 can move vertically. A spring not shown in the drawings is disposed on the underside of the paper pressing plate 8 and urges the paper pressing plate 8 upward. The paper pressing plate 8 pivots downward against the urging force of the spring by an amount corresponding to the number of sheets 3 stacked on the paper pressing plate 8. The spring urges the sheets 3 stacked on the paper pressing plate 8 toward the feed roller 12, so that the uppermost sheet 3 in the stack is conveyed by the rotation of the feed roller 12 between the feed roller 12 and separating pad 13. Through the cooperative operations of the feed roller 12 and separating pad 13, the sheets 3 are separated and fed into the laser printer 1 one sheet at a time. The supplied sheet 3 is conveyed to the registration rollers 11 by the first conveying rollers 9 and second conveying rollers 10.

The pair of registration rollers 11 adjust the orientation of the sheet 3 in a registration operation and then convey the sheet 3 to a transfer position where a photosensitive drum 23 and a transfer roller 25 contact each other.

The feeder unit 4 further includes a multipurpose tray 14 on which is stacked an optionally size sheet 3, a multipurpose feeding mechanism 15 for feeding the sheet 3 stacked on the multipurpose tray 14 into the laser printer 1, and multipurpose conveying rollers 16.

The multipurpose feeding mechanism 15 includes a multipurpose feeding roller 15*a*, a multipurpose separating pad 15*b* in confrontation with the multipurpose feeding roller 15*a*, and a spring 15*c* disposed on the underside of the multipurpose separating pad 15*b*. The urging force of the spring 15*c* presses the multipurpose separating pad 15*b* against the multipurpose feeding roller 15*a*.

The topmost sheet among the sheets 3 stacked on the multipurpose tray 14 enters between the multipurpose feeding roller 15*a* and the multipurpose separating pad 15*b* from rotation of the multipurpose feeding roller 15*a*. Through the cooperative operation of the multipurpose feeding roller 15*a* and the multipurpose separating pad 15*b*, the sheets 3 stacked on the multipurpose tray 14 are separated and fed toward the registration rollers 11 one sheet at a time.

The image forming unit 5 includes a scanning unit 17, a processing unit 18, and a fixing unit 19.

The scanning unit 17 is provided in the top section of the main casing 2 and includes a laser light-emitting unit (not shown), a polygon mirror 20 that can be driven to rotate, lenses 21*a* and 21*b*, and a reflecting mirror 21*c*. A laser beam indicated by the dotted line in FIG. 1 is emitted by the laser light-emitting unit based on image data and sequentially passes through or reflects off the polygon mirror 20, the lens 21*a*, the reflecting mirror 21*c*, and the lens 21*b* before being irradiated in a high-speed scanning operation on the surface of the photosensitive drum 23 in the processing unit 18.

The processing unit 18 is disposed below the scanning unit 17 and is detachably mounted in the main casing 2. The processing unit 18 includes a drum cartridge 22 that accommodates the photosensitive drum 23, a developer cartridge 24, the transfer roller 25, and a scorotron charger 26.

The developer cartridge 24 is detachably mounted on the drum cartridge 22. The developer cartridge 24 can be mounted on or detached from the drum cartridge 22 either while the drum cartridge 22 is mounted in or separated from the main casing 2.

Figure 2:
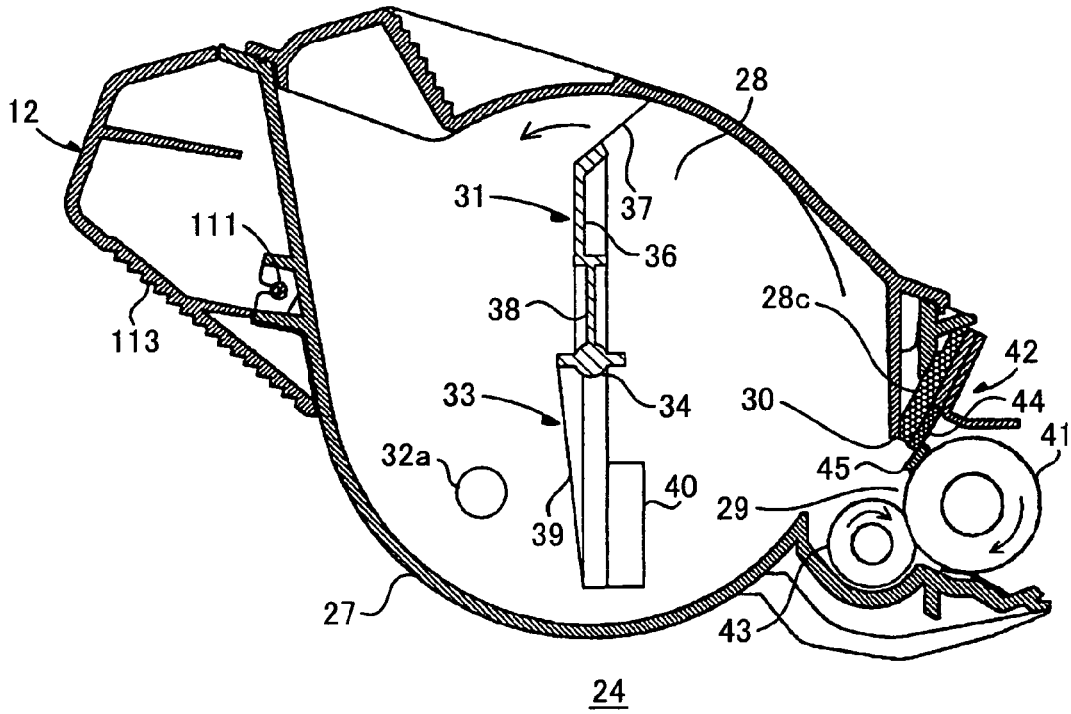
FIG. 2 is a side cross-sectional view showing relevant components of a developer cartridge of the laser printer in FIG. 1.

As shown in FIG. 2, the developer cartridge 24 includes a casing 27. A toner compartment 28 for accommodating toner and a developing section 29 are formed separately in the casing 27. A toner supply opening 30 is formed in the partitioning wall between the toner compartment 28 and developing section 29.

Figure 3:
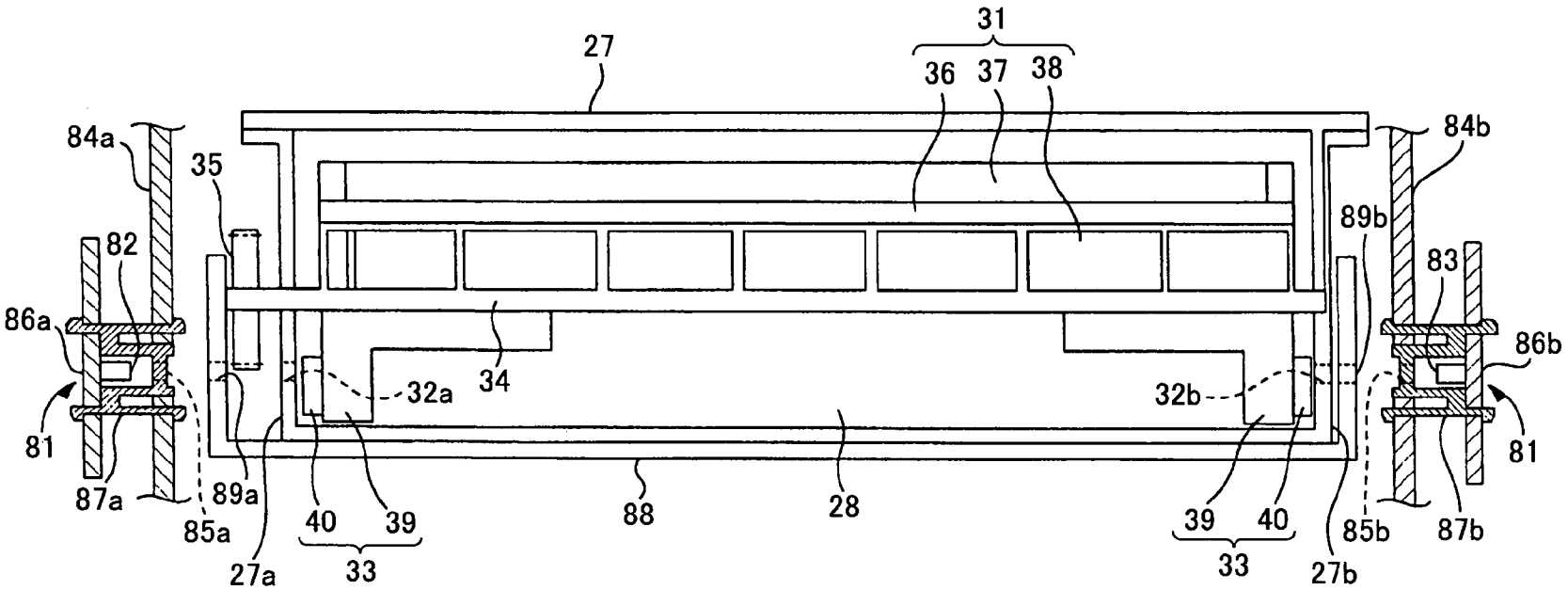
FIG. 3 is a back cross-sectional view showing relevant components of the developer cartridge of FIG. 2 while mounted in the laser printer in FIG. 1.

The toner compartment 28 is filled with a nonmagnetic, single-component toner having a positively charging nature. As shown in FIGS. 2 and 3, the toner compartment 28 accommodates an agitator 31, wipers 33, and a rotating shaft 34. The agitator 31 is for agitating the toner and supplying the toner into the developing section 29 through the toner supply opening 30. The wipers 33 are for cleaning the light-transmissive windows 32*a* and 32*b* described later. The rotating shaft 34 supports the agitator 31 and wiper 33.

The toner used in the embodiment is a polymerized toner obtained by copolymerizing a polymerized monomer using a well-known polymerization method such as suspension polymerization. The polymerized monomer may be, for example, a styrene monomer such as styrene or an acrylic monomer such is as acrylic acid, alkyl (C1-C4) acrylate, or alkyl (C1-C4) meta acrylate. The polymerized toner is formed as particles substantially spherical in shape and so has excellent fluidity. Wax and a coloring agent such as carbon black are mixed in the toner. Also, an additive such as silica is added to improve fluidity. The diameter of the toner particles is about 6-10 μm.

As shown in FIG. 3, the casing 27 has side walls 27*a* and 27*b* at opposite sides of the toner compartment 28. The rotating shaft 34 extends between the side walls 27*a* and 27*b* through the approximate center of the toner compartment 28. The rotating shaft 34 protrudes from the side wall 27*a*. A gear 35 is provided on the end protruding from the side wall 27*a*. The gear 35 receives drive force from a main motor 97 (see FIG. 4) to drive the shaft 34 to rotate.

As shown in FIGS. 2 and 3, the agitator 31 extends along the length of the rotating shaft 34. The agitator 31 includes a support member 36 and a scraping member 37. The support member 36 is formed from a resin and extends diametrically outward from the rotating shaft 34. The scraping member 37 is formed from a resinous film, such as polyethylene terephthalate, and is disposed on the free edge of the support member 36.

Openings 38 for reducing the resistance of toner during agitation are formed along the length of the support member 36 separated by a predetermined interval.

The wipers 33 are provided at both lengthwise ends of the rotating shaft 34 and at positions on the rotating shaft 34 that are 180 degrees away from the agitator 31. Each of the wipers 33 includes an L-shaped support member 39 and a cleaner member 40. The L-shaped support member 39 is formed from a resin that extends lengthwise along the rotating shaft 34. The cleaner member 40 is formed from a urethane rubber and is provided on the side of the L-shaped support member 39.

When the motive force from the main motor 97 is transferred to the gear 35, the rotating shaft 34 is driven to rotate. Accordingly, the agitator 31 rotates in the toner compartment 28, as the scraping member 37 slidingly contacts the bottom surface of the toner compartment 28, which has a substantially cylindrical shape. As a result of this action, the toner in the toner compartment 28 is forced up and some of the toner is discharged through the toner supply opening 30 into the developing section 29.

At the same time, the wipers 33 also rotate in the toner compartment 28. The cleaner members 40 contact the light-transmissive windows 32*a* and 32 while rotating and wipe off any toner deposited on the light-transmissive windows 32*a* and 32.

Because the agitator 31 and wipers 33 are supported on the same rotating shaft 34, the wipers 33 clean the light-transmissive windows 32*a* and 32*b* each time the agitator 31 rotates and agitates the toner. This is the case regardless of the rotational speed of the rotating shaft 34. Accordingly, the accuracy of a toner sensor 81 (see FIG. 4) described later for detecting the remaining amount of toner in the processing unit 18 can be improved.

As shown in FIG. 2, the developing section 29 accommodates a developing roller 41, a thickness regulating blade 42, and a feed roller 43.

The feed roller 43 is disposed in the bottom of the toner supply opening 30 and can rotate clockwise as indicated by an arrow in FIG. 2. The feed roller 43 includes a metal roller shaft covered by a roller formed from an electrically conductive sponge material.

The developing roller 41 is disposed to the side of the feed roller 43 and can rotate clockwise as indicated by the arrow in FIG. 2. The feed roller 43 is also configured from a metal shaft covered by a roller made from an electrically conductive resilient material. More specifically, the roller of the developing roller 41 is formed from an electrically conductive urethane rubber or silicon rubber including fine carbon particles. The surface of the rubber roller is coated with a urethane rubber or silicon rubber including fluorine. The developing roller 41 is applied with a developing bias in relation to the photosensitive drum 23. The rotating shaft 34 and the developing roller 41 are in pressing contact with each other. Motive force from the main motor 97 is transferred to the developing roller 41.

The thickness regulating blade 42 is disposed near to and in confrontation with the top of the developing roller 41 and extends along the axial direction of the developing roller 41. The thickness regulating blade 42 includes a leaf spring 44 and a pressing part 45. The pressing part 45 is provided on the end part of the leaf spring 44 and maintained in contact with the developing roller 41. The pressing part 45 has a semicircular cross section and is formed from an insulating silicon rubber. The resilient force of the leaf spring 44 presses the pressing part 45 into contact with the surface of the developing roller 41.

The agitator 31 rotates counterclockwise as indicated by the arrow in FIG. 2. This agitates the toner in the toner compartment 28 while conveying the toner to the developing section 29 through the toner supply opening 30, Toner conveyed into the developing section 29 is subsequently supplied to the developing roller 41 by rotation of the feed roller 43. At this time, the toner is positively tribocharged between the feed roller 43 and developing roller 41. As the developing roller 41 rotates, the toner supplied to the surface of the developing roller 41 passes between the developing roller 41 and the pressing part 45 of the thickness regulating blade 42 so that the toner is regulated to a uniform thickness on the surface of the developing roller 41.

As shown in FIG. 1, the photosensitive drum 23 is disposed to the side of and in confrontation with the developing roller 41 and can rotate counterclockwise as indicated by the arrow in FIG. 1. The photosensitive drum 23 is formed from a main drum body that is grounded and a surface portion formed from a positively charged photosensitive layer of polycarbonate or the like.

The scorotron charger 26 is disposed above and separated a prescribed distance from the photosensitive drum 23 so as not to contact the surface of the photosensitive drum 23. The scorotron charger 26 is a positively charging scorotron charger having a charging wire formed from tungsten from which a corona discharge is generated. The scorotron charger 26 charges the entire surface of the photosensitive drum 23 to uniform positive-polarity charge.

As the photosensitive drum 23 rotates, the scorotron charger 26 charges the entire surface of the photosensitive drum 23 to a positive charge. Subsequently, the surface of the photosensitive drum 23 is exposed to the high-speed scanning of a laser beam emitted from the scanning unit 17, forming latent images on the surface based on prescribed image data. The potential of the uniformly charged surface of the photosensitive drum 23 is reduced at portions that are exposed by the laser beam. In this way, a electrostatic latent image is formed on the surface of the photosensitive drum 23.

Next, the positively charged toner carried on the surface of the developing roller 41 is brought into contact with the photosensitive drum 23 as the developing roller 41 rotates. At this time, the electrostatic latent image on the surface of the photosensitive drum 23 is developed into a visible image when the toner is selectively attracted to portions of the photosensitive drum 23 that were exposed to the laser beam. In this way, a reverse image is formed.

The transfer roller 25 is rotatably supported in the drum cartridge 22 at a position below and in opposition with the photosensitive drum 23. The transfer roller 25 includes a metal roller shaft covered by a roller that is formed from an electrically conductive rubber material. During the transfer process, the transfer roller 25 is applied with a transfer bias in relation to the photosensitive drum 23. As a result, the toner image carried on the surface of the photosensitive drum 23 is transferred to the sheet 3, as the sheet 3 passes between the photosensitive drum 23 and transfer roller 25. After the toner image is transferred in this way, the sheet 3 is conveyed to the fixing unit 19 by a conveying belt 46.

The fixing unit 19 is disposed to the side of and downstream from the processing unit 18. The fixing unit 19 includes a heat roller 47, a pressure roller 48 applying pressure to the heat roller 47, and a pair of conveying rollers 49 disposed downstream from the heat roller 47 and the pressure roller 48.

The heat roller 47 is formed from a metal material and is provided with a halogen lamp as a heat source. The heat from the heat roller 47 fixes the toner that was transferred onto the sheet 3 in the processing unit 18 onto the surface of the sheet 3 as the sheet 3 passes between the heat roller 47 and pressure roller 48. Subsequently, the conveying rollers 49 convey the sheet 3 to a pair of conveying rollers 50 disposed on the main casing 2. The conveying rollers 50 convey the sheet 3 to a pair of paper discharge rollers 51. The paper discharge rollers 51 discharge the sheet 3 onto a discharge tray 52.

The laser printer 1 of the embodiment employs what is known as a cleanerless developing system for recovering residual toner. In the cleanerless developing system, the developing roller 41 recovers toner remaining on the surface of the photosensitive drum 23 after operation of the transfer roller 25 transfers the toner image onto the sheet 3. This type of cleanerless developing system to recover residual toner requires no blade for removing residual toner or reservoir for recovering waster toner. The configuration can be simplified because such components are not needed.

The laser printer 1 of the embodiment is further provided with a retransport unit 61 to enable images to be formed on both sides of the sheet 3. The retransport unit 61 is integrally configured from a reversing mechanism 62 and a retransport tray 63. The reversing mechanism 62 is attached to the back end of the main casing 2 and the retransport tray 63 is detachably mounted in the main casing 2 and inserted over the feeder unit 4.

The reversing mechanism 62 includes a casing 64, a pair of reversing rollers 66, and a pair of retransport rollers 67. The casing 64 is mounted on the back panel of the main casing 2 and has a substantially rectangular cross section. A reverse guide plate 68 protrudes upward from the top of the casing 64.

A flapper 65 is disposed downstream from the conveying rollers 49. The flapper 65 selectively guides the sheet 3, which is formed on one side with a toner image, from the conveying rollers 49 toward either the conveying rollers 50 along a path indicated in solid line or the reversing rollers 66 along a path indicated in dotted line. The flapper 65 is rotatably supported near to and downstream from the conveying rollers 49 in the back section of the main casing 2. Although not shown in the drawings, a solenoid is provided for pivoting the flapper 65. By switching the excitation state of the solenoid, the flapper can be pivoted to select the transport direction of the sheet 3 from the conveying rollers 49 to either the conveying rollers 50 (solid line) or the reversing rollers 66 (dotted line).

The pair of reversing rollers 66 is disposed in the top section of the casing 64 downstream from the flapper 65. The reversing rollers 66 are capable of rotating both forward and backward. The reversing rollers 66 first rotate in the forward direction to convey the sheet 3 toward the reverse guide plate 68, and subsequently rotate in the reverse direction to convey the sheet 3 in the opposite direction.

The pair of retransport rollers 67 is provided in the casing 64 almost directly below and downstream from the reversing rollers 66. The retransport rollers 67 can convey the sheet 3 conveyed in the reverse direction by the reversing rollers 66 to the retransport tray 63.

The reverse guide plate 68 is a plate-shaped member that extends upward from the top of the casing 64 for guiding the sheet 3 conveyed by the reversing rollers 66.

When images are to be formed on both sides of a sheet 3, the flapper 65 is first switched to convey the sheet 3 toward the reversing rollers 66. The reversing mechanism 62 receives the sheet 3 having an image formed on one side surface. After the sheet 3 is conveyed to the reversing rollers 66, the reversing rollers 66 rotate in a forward direction with the sheet 3 interposed therebetween to convey the sheet 3 upward and outward along the reverse guide plate 68. Once a major part of the sheet 3 has been conveyed outward, and while the trailing edge of the sheet 3 is still interposed between the pair of reversing rollers 66, the forward rotation of the reversing rollers 66 is halted. Subsequently, the reversing rollers 66 rotate in the reverse direction to convey the sheet 3 almost directly downward toward the retransport rollers 67. A paper sensor 76 is disposed downstream from the fixing unit 19 for detecting the trailing edge of the sheet 3. The reversing rollers 66 are switched from a forward rotation to a reverse rotation when a prescribed time has elapsed after the paper sensor 76 detects the trailing edge of the sheet 3. After the sheet 3 has been conveyed to the reversing rollers 66, the flapper 65 is returned to its original position in order that the next sheet 3 transferred from the conveying rollers 49 is conveyed to the conveying rollers 50.

After the reversing rollers 66 convey the sheet 3 in reverse to the retransport rollers 67, the retransport rollers 67 convey the sheet 3 into the retransport tray 63.

The retransport tray 63 includes a paper feeding unit 69, a main tray 70, and skewed rollers 71.

The paper feeding unit 69 is mounted on the back of the main casing 2 below the reversing mechanism 62. The paper feeding unit 69 is provided with a curved paper guide member 72 for guiding the vertically-oriented sheet 3 from the retransport rollers 67 in a substantially horizontal direction within the paper feeding unit 69 and for conveying the sheet 3 in a substantially horizontal orientation toward the main tray 70.

The main tray 70 has a substantially rectangular plate shape. The main tray 70 is disposed above the feed tray 6 and has an approximately horizontal posture. The upstream end of the main tray 70 is located adjacent to the curved paper guide member 72 and the downstream end is located adjacent to the upstream end of a retransport path 73. The retransport path 73 is positioned at the upstream side of the second conveying rollers 10.

Two sets of skewed rollers 71 are disposed along the conveying path on the main tray 70, separated by a prescribed interval in the conveying direction of the sheet 3. The skewed rollers 71 are for conveying the sheet 3 along the main tray 70 while maintaining the side edge of the sheet 3 in contact with an aligning plate (not shown).

The aligning plate (not show) is provided on one side of the main tray 70 and extends widthwise along the main tray 70. The skewed rollers 71 are provided near the aligning plate. Each set of skewed rollers 71 includes a skewed driving roller 74 and skewed follow rollers 75. The skewed driving roller 74 have axes substantially orthogonal to the conveying direction of the sheet 3. The skewed follow rollers 75 are disposed in confrontation with the skewed driving rollers 74. Sheet 3 are transported interposed between the skewed follow rollers 75 and the skewed driving rollers 74. The skewed follow rollers 75 are disposed with their axes of rotation slanted from orthogonal with the conveying direction of the sheet 3 in a direction for guiding the sheets 3 toward the aligning plate.

When the sheet 3 is transferred from the paper feeding unit 69 onto the main tray 70, the skewed rollers 71 convey the sheet 3 toward the retransport path 73 while abutting one side edge of the sheet 3 against the aligning plate. At this time, the front and back surfaces of the sheet 3 have been reversed. When the sheet 3 is once again conveyed to the transfer position through the retransport path 73, the back surface of the sheet 3 comes into contact with the photosensitive drum 23. A toner image is transferred from the photosensitive drum 23 to this back surface and subsequently fixed in the fixing unit 19. The sheet 3 is discharged onto the discharge tray 52 having images on both sides.

In the laser printer 1 of the embodiment, a top cover 53 is provided in the main casing 2. The top cover 53 can be freely opened and closed. By opening the top cover 53, it is possible to mount or remove the developer cartridge 24 and the like.

The toner sensor 81 is provided in the laser printer 1 for detecting the amount of toner remaining in the toner compartment 28 of the developer cartridge 24. As shown in FIG. 3, the toner sensor 81 is includes a light-emitting unit 82 and a light-receiving unit 83.

Here, configuration relating to the toner sensor 81 will be described. The light-transmissive windows 32*a* and 32*b* are provided in the side walls 27*a* and 27*b*, respectively, at positions that are directly opposite from each other and that are below the center of the toner compartment 28. A case part 88 of the drum cartridge 22 has a bottom and two sides, as shown in FIG. 3, that surround the lower portion of the developer cartridge 24. Window openings 89*a* and 89*b* are formed in both side walls of the case part 88 at positions corresponding to the light-transmissive windows 32*a* and 32*b*. The main casing 2 includes frame members 84*a* and 84*b* that are located to the outside of the opposite sides of the developer cartridge 24.

On the light-emitting unit 82 side, a holder member 87*a* is supported on the frame member 84*a* at a position corresponding to and outside from the window opening 89*a*. A support base 86*a* is supported by the holder member 87*a* at a position to the outside from the frame member 84*a*. A lens 85*a* is embedded in the frame member 84*a* at a position opposing the outer side of the light-transmissive window 32*a*. The light-emitting unit 82 is mounted on the surface of the support base 86*a* at a position that corresponds to the lens 85*a*. The light-emitting unit 82 is oriented so that a light-emitting element in the light-emitting unit 82 points toward the lens 85*a*. The light emitting element of the light-emitting unit 82 emits light having strong directivity.

On the light-receiving unit 83 side, a holder member 87*b* is supported on the frame member 84*b* at a position corresponding to and outside from the window opening 89*b*. A support base 86*b* is supported by the holder member 87*b* at a position to the outside from the frame member 84*b*. A lens 85*b* is embedded in the frame member 84*b* at a position opposing the light-transmissive window 32*b*. The light-receiving unit 83 is mounted on the surface of the support base 86*b* at a position that corresponds to the lens 85*b*. The light-receiving unit 83 is oriented so that a light-receiving element in the light-receiving unit 83 points toward the lens 85*b*.

Hence, the light-emitting unit 82, the lens 85*a*, the window opening 89*a*, and the light-transmissive window 32*a* are aligned on an imaginary straight line with the light-receiving unit 83, the lens 85*b*, the window opening 89*b*, and the light-transmissive window 32*b* with the toner compartment 28 interposed therebetween. With this configuration, the light emitted from the light-emitting unit 82 passes through the lens 85*a*, the window opening 89*a*, and the light-transmissive window 32*a*, into the toner compartment 28, and through the light-transmissive window 32*b*, the window opening 89*b*, and the lens 85*b* and is received in the light-receiving unit 83.

The voltage outputted from the light-emitting element varies according to the amount of light received in the light-receiving unit 83. The output voltage is high, for example, 5 V, when no light is received. The output voltage is low, for example, 0 V, when a large amount of light is received. By detecting variations in the output voltage, it is possible to determine whether light passing through the toner compartment 28 is blocked by toner and, hence, to determine the status of toner remaining in the toner compartment 28.

When light traveling from the light-emitting unit 82 to the light-receiving unit 83 is blocked by toner in the toner compartment 28, the toner sensor 81 indicates a "full state" wherein sufficient toner remains in the toner compartment 28. On the other hand, when light traveling from the light-emitting unit 82 to the light-receiving unit 83 is not blocked by toner but is able to pass through the toner compartment 28, then the toner sensor 81 indicates an "empty state" wherein no toner remains in the toner compartment 28.

Figure 4:
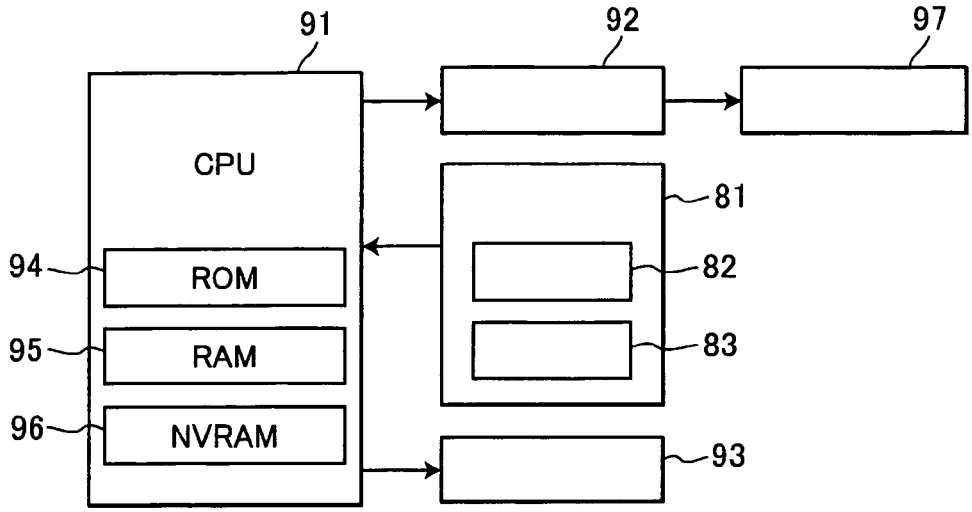
FIG. 4 is a block diagram showing a control system of the laser printer of FIG. 1.

FIG. 4 is a block diagram showing a control system in which the toner sensor 81 detects the status of toner remaining in the toner compartment 28. The control system includes a CPU 91, a drive circuit 92, the toner sensor 81, and a display panel 93. The drive circuit 92, the toner sensor 81, and the display panel 93 are connected to the CPU 91.

The CPU 91 includes a ROM 94, a RAM 95, and an NVRAM 96. The ROM 94 stores a main control program, an initial display program, and a new/used determining program. The main control program is for controlling image forming operations in the laser printer 1. The RAM 95 temporarily stores numerical values and other data set during execution of various programs. The NVRAM 96 stores the remaining toner status detected by the toner sensor 81 and determined by the CPU 91. The NVRAM 96 continues to preserve numerical values by means of a backup battery, even when a power unit (not shown) of the laser printer 1 is turned off. The power unit supplies power to various components of the laser printer 1, including components related to image formation.

The main motor 97 described earlier is connected to the drive circuit 92. The main motor 97 is connected to the feed roller 12, the photosensitive drum 23, the developing roller 41, and the heat roller 47, and other components of the laser printer 1 that require drive force. Such components will be referred to as "driven components" hereinafter. The CPU 91 controls the drive circuit 92 to drive the main motor 97 and consequently drive the driven components.

A clutch mechanism not shown in the drawings is connected to the drive circuit 92. Through control by the CPU 91, the clutch mechanism appropriately controls driven components during image forming operations and during a warm-up operation described later. During the warm-up operation, the clutch mechanism rotates driven components of the developer cartridge 24 without performing an image forming operation. The driven components of the developer cartridge 24 include the agitator 31, the wipers 33, and the developing roller 41. The agitator 31 and the wipers 33 are provided on the rotating shaft 34.

The display panel 93 includes LEDs for displaying various settings of the laser printer 1. For example, the display panel 93 selectively displays the remaining toner status using such messages as "full state," "low state," or "empty state."

The CPU 91 of the laser printer 1 detects voltage from the light-receiving unit 83 as an output signal from the light-receiving unit 83 and determines the remaining toner status from the percentage of variations in the output signal over unit time.

Figure 5:
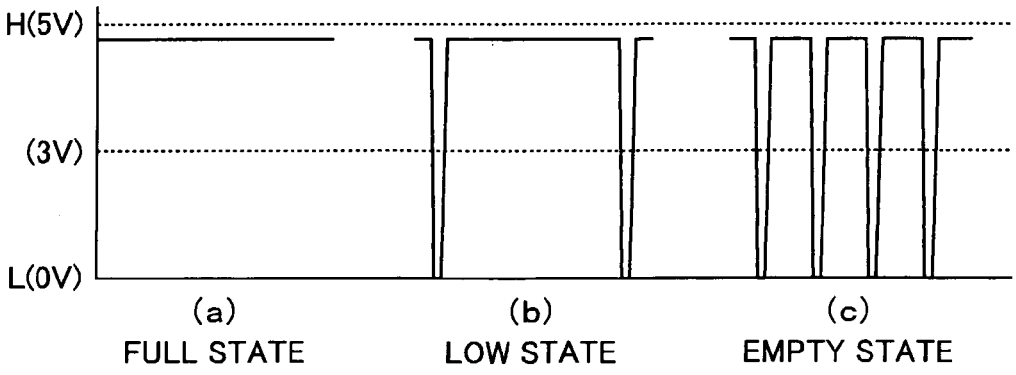
FIG. 5 is a graph showing remaining toner status detected by a toner sensor in the laser printer of FIG. 1.

More specifically, when light emitted from the light-receiving unit 83 is received in the light-emitting unit 82 without being blocked in the toner compartment 28, then the light-receiving unit 83 outputs a low voltage (0V). As shown in FIG. 5, a low voltage (0 V) is recognized as a LOW level output signal. However, when light emitted from the light-emitting unit 82 is blocked in the toner compartment 28, then the light-receiving unit 83 outputs a high voltage (5 V). A high voltage (5 V) is recognized as a HIGH level output signal.

The light emitted from the light-emitting unit 82 is periodically blocked by the rotating agitator 31 when the toner compartment 28 is out of toner. Therefore, the output signal continuously alternates between the HIGH level and LOW level due to these periodic rotations when the toner compartment 28 is out of toner. However, when there is sufficient toner in the toner compartment 28, light emitted from the light-emitting unit 82 is constantly blocked by the toner. Hence, when there is sufficient toner in the toner compartment 28, the level will be continuously HIGH as indicated by section (a) of FIG. 5.

As more image forming operations are performed and the amount of remaining toner decreases, the toner reaches a level at which light emitted from the light-emitting unit 82 is only blocked when the toner remaining in the toner compartment 28 is pushed up by the rotating agitator 31. Accordingly, the output level will periodically alternate between HIGH and LOW at a certain ratio. If a fairly large amount of toner is left in the toner compartment 28, then the agitator 31 will push up a fairly large amount of toner with each sweep. Therefore, light will be blocked for a fairly long period of time and the ratio of HIGH level to LOW level will be great as indicated in section (b) of FIG. 5. As the amount of remaining toner continues to decrease through image forming operations, the light emitted from the light-emitting unit 82 will almost never be blocked by stirred-up toner. At this time, the ratio of HIGH level to LOW level will very small as indicated in section (c) of FIG. 5.

A reference voltage is designated between the LOW level voltage (0 V) and the HIGH level voltage (5 V). According to the embodiment, the reference voltage is 3 V. The CPU 91 determine the remaining toner status in three levels by counting the number of times that the output voltage drops below this reference voltage.

According to the embodiment, the CPU 91 monitors the amount of toner in the developer cartridge 24 by checking the output voltage from the light-receiving unit 83 400 times during each unit of 5 μs. (It should be noted that the number of check times and the unit of time can be varied as needed.) The CPU 91 determines a "full state" (section (a) of FIG. 5) when the output voltage drops below the reference voltage (3 V) less than 2% of the checks; a "low state" (section (b) of FIG. 5) when the output voltage drops below the reference voltage greater than or equal to 2% and less than 20% of the time; and an "empty state" (section (c) of FIG. 5) when the output voltage drops below the reference voltage 20% or more of the time.

When the laser printer 1 is performing an image forming operation, the CPU 91 executes a real-time monitor program stored in the ROM 94 and accordingly selectively displays toner status messages on the display panel 93 based on the "full state," "low state," or "empty state" that the CPU 91 determines in the manner described above. During this time, the CPU 91 sequentially stores the determined status in the NVRAM 96. The laser printer 1 of the embodiment further halts driving of the main motor 97 when an empty states is determined.

Hence, using this method for detecting the amount of remaining toner, the CPU 91 can accurately detect the remaining toner status by determining this status according to the ratio of light transmitted from the light-emitting unit 82 received in the light-receiving unit 83.

When the laser printer 1 is performing an image forming operation, the real monitor program selectively displays the "full state" "low state," or "empty state" determined by the CPU 91 on the display panel 93. Accordingly, the laser printer 1 can accurately display the remaining toner status in a normal operating state.

Moreover, the CPU 91 determines whether the status remaining toner is a full, low, or empty state, wherein these states are in the order of greatest remaining toner. The CPU 91 displays the determined state on the display panel 93. Therefore, it is possible to accurately display the remaining toner status using a simple construction.

During the warm-up operation, the agitator 31 and the developing roller 41 are driven to rotate without image processes being performed. It can be difficult to accurately determine the amount of toner in the toner compartment 28 during the warm-up operation. For example, when the laser printer 1 remains inactive for a long period of time, such as a week, the toner settles in the toner compartment 28 so that the overall volume of toner decreases. The toner remains relatively compacted during the warm-up operation so that the volume of the toner is smaller during the warm-up operation than during normal operations. As a result, the light ratio at the light-receiving unit 83 is greater during the warm-up operation than during normal operations. Here, "light ratio" refers to the amount of light received by the light-receiving unit 83 compared to the light emitted from the light-emitting unit 82 over each predetermined unit of time. For example, a light ratio of 1 means that the light-receiving unit 83 receives all of the light emitted from the light-emitting unit 82 over that predetermined unit of time.

Also, the toner used in the laser printer 1 of the embodiment is made from substantially spherical-shaped particles that tend to settle in the toner compartment 28. Because the toner settles rather quickly, the light ratio at the light-receiving unit 83 is greater during the warm-up operation than the light ratio during normal operations even though the amount of toner is the same.

Because the detected light ratio is greater during the warm-up operation than during normal operating conditions, the remaining toner status cannot be detected accurately. The laser printer 1 employs an initial display program that controls the display panel 93 to display the remaining toner status based on the remaining toner status detected during the warm-up operation using the toner sensor 81 and the remaining toner status stored in the NVRAM 96.

Figure 6:
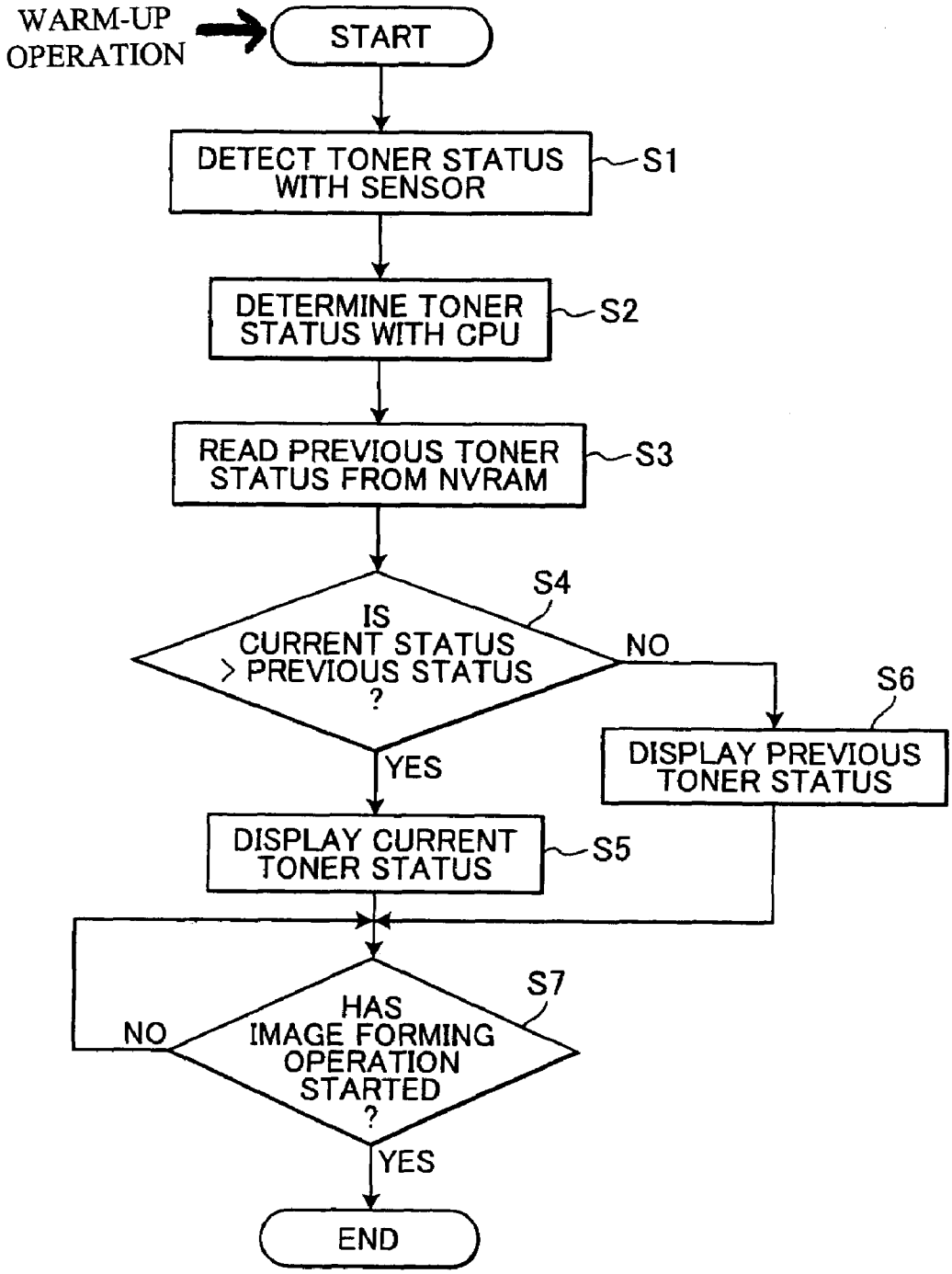
FIG. 6 is a flowchart representing processes of an initial display program.

Next, processes performed during the initial display program will be described with reference to FIG. 6. The initial display program is started when a warm-up operation is executed during the main control program.

The warm-up operation is performed, for example, as part of preparations (status check) for an image forming operation. The warm-up operation includes driving driven components in the developer cartridge 24, such as the agitator 31 and wipers 33 provided on the rotating shaft 34 and the developing roller 41, without performing an image forming operation. According to the embodiment, the warm-up operation is executed directly after the power unit of the laser printer 1 is turned on, directly after a reset function is executed, directly after the laser printer 1 is switched out of its sleep mode, and when the top cover 53 is opened and closed.

The laser printer 1 is reset in accordance with a reset signal. The reset signal is when the user operates a certain key or keys on the control panel of the laser printer 1 or an external personal computer not shown in the drawings. Also, the reset signal is inputted automatically when the developer cartridge 24 is determined to be new in a manner to be described later.

During the sleep mode, power from the power unit is only supplied to essential components of the laser printer 1. Power to nonessential components is stopped during the sleep mode. The laser printer 1 enters the sleep mode after no image forming operations have been performed for a certain period of time. The laser printer 1 is switched out of the sleep mode when, for example, print data is received. The initial display program is executed simultaneously with the warm-up operation at these times. That is, because toner settles in the toner compartment 28 and this settling can result in the display of an incorrect status, the initial display program is executed when the power unit of the laser printer 1 is turned on, when the laser printer 1 is reset, or restored from a sleep mode, and when the top cover 53 is opened and closed in order to display an accurate remaining toner status on the display panel 93.

At the beginning of the process of the initial display program, in S1 the toner sensor 81 detects the status of toner remaining in the toner compartment 28. In S2 the CPU 91 judges whether the amount of remaining toner indicated by the toner sensor 81 is a "full state," "low state," or "empty state". Hereinafter, amount of remaining toner determined by the CPU 91 based on detection results will be referred to as the "current toner status." In S3 the remaining toner status stored in the NVRAM 96 is extracted from the NVRAM 96. Hereinafter, the remaining toner status stored in the NVRAM 96 will be referred to as the "previous toner status." The previous toner status is, for example, the remaining toner status that was last detected during the image forming operation that was performed just prior to executing the current warm-up operation. In other words, the previous toner status is the remaining toner status that was detected during normal operations when the toner compartment 28 held essentially the same amount of toner as during the current warm-up operation. In S4, the current toner status is compared to the previous toner status. If the current toner status indicates a larger amount of toner than the previous toner status (S4: YES), then in S5 the current toner status is displayed on the display panel 93. However, if the current toner status indicates a remaining toner amount that is less than or equal to the previous toner status (S4: NO), then in S6 the previous toner status is displayed on the display panel 93. Hence, the processes in S4-S6 compare the current toner status with the previous toner status and display the larger of the two on the display panel 93.

Figures 7, 8:
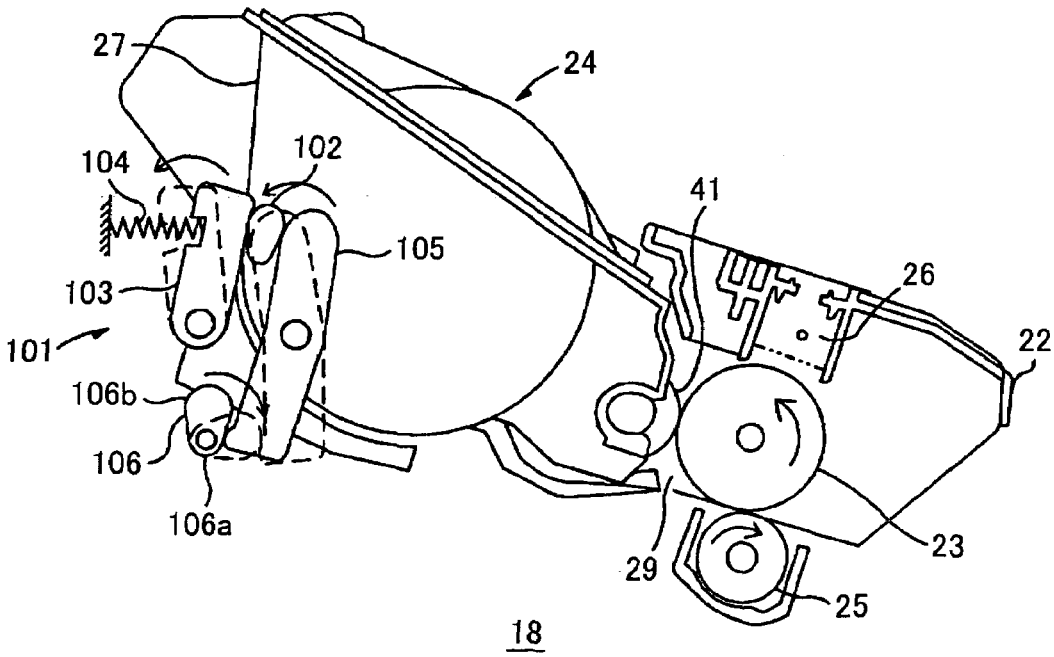
FIG. 7 is a table showing examples of remaining toner status displayed in accordance with the initial display program.
FIG. 8 is a side cross-sectional view showing relevant components of a processing unit in the laser printer of FIG. 1.

FIG. 7 lists examples of these types of displays. In examples 1, 5, and 9 of FIG. 7, both the previous toner status and current toner status indicate the same remaining toner status. In such a situation, the common toner status is displayed.

In examples 2, 3, and 6 of FIG. 7, the current toner status is greater than the previous toner status. This corresponds to the situation wherein the developer cartridge 24 is replaced with a developer cartridge 24 filled with more toner in between the previous detection and the current detection. Under these circumstances, the current toner status is displayed. More specifically, when the previous toner status is an "empty" states and the current toner status is either a "low state" or a "full state" (examples 2 and 3, respectively), then the current toner status ("low state" or "full state") is displayed. When the previous toner status is a "low state" and the current toner status is a "full state" (example 6), then current toner status ("full state") is displayed.

In examples 4, 7, and 8 of FIG. 7, the current toner status is lower than the previous toner status. Under these circumstances, the previous toner status is displayed. More specifically, when the previous toner status is "low state" and the current toner status is "empty state" (example 4) then the previous toner status of "low state" is displayed. When the previous toner status is "full state" and the current toner status is either "empty state" or "low state" (examples 7 and 8, respectively), then the previous toner status of "full state" is displayed.

The examples of 4, 7, and 8 described above might occur during a warm-up operation that is being performed before an image forming operation and after a long period of inactivity of the laser printer 1. As described above, toner in the toner compartment 28 settles after a long period of inactivity. The agitator 31 will not be able to sufficiently stir up the toner during a warm-up operation performed after a long period of inactivity. Therefore, even though the same amount of toner remains in the toner compartment 28 during such a warm-up operation as during a normal image forming operation, the CPU 91 will erroneously determine that a smaller amount of toner remains during the warm-up operation than during the normal image forming operation. However, during this type of situation, the initial display program controls to display the previous toner status instead of the current toner status. Because the previous toner status is based on the amount of remaining toner detected during an image forming operation wherein the toner compartment 28 accommodated substantially the same amount or toner as during the current warm-up operation, the amount of residual toner will be accurately displayed.

Because the CPU 91 executes the initial display program during warm-up operations, the CPU 91 displays the correct remaining toner status, even during this type of warm-up operation when, because the toner in the toner compartment 28 settled, the current toner status is determined to be a smaller amount than the remaining toner status that was previously detected during normal operations. In this case, the CPU 91 compares the current toner status to the previous toner status and displays the larger of the two on the display panel 93.

The NVRAM 96 stores the remaining toner status last displayed on the display panel 93 and not the status detected during the present warm-up operation. Accordingly, if the power unit of the laser printer 1 is turned on and the initial display program is executed and the power unit is subsequently turned off without performing an image forming operation, then it is still possible to display an accurate toner status on the display panel 93 during the initial display program executed the next time the power unit of the laser printer 1 is turned on.

The initial display program continues to run as long as no image forming process is initiated (S7: NO). When an image forming operation is initiated (S7: YES), the initial display program ends. An example of when an image forming operation actually begins is the point in time when the feed roller 12 is driven to supply the sheet 3 into the laser printer 1.

With the above-described configuration, the remaining toner status will can be accurately displayed both before and after an image forming operation begins. That is, once an image forming operation is initiated, the initial display program is ended and the real monitor program described above is executed. During the real monitor program, the CPU 91 controls the display panel 93 to display the remaining toner status that the CPU 91 determined based on detection by the toner sensor 81. Hence, the remaining toner status will also be accurately displayed during normal operations when an image forming operation is executed.

The developer cartridge 24 is configured with a contacting/separating mechanism 101 as shown in FIG. 8. The contacting/separating mechanism 101 functions to move the developing roller 41 into contact with the photosensitive drum 23 while developing processes are being performed and to separate the developing roller 41 from the photosensitive drum 23 when no developing processes are being performed.

The contacting/separating mechanism 101 includes an engaging part 102, a pressure plate 103, a pressure spring 104, a pivoting plate 105, and a cam 106. The engaging part 102 protrudes horizontally from the casing 27 of the developer cartridge 24. The pressure plate 103 is supported at its lower on a shaft provided on the main casing 2. The pressure plate 103 is freely pivotable about the shaft. The pressure spring 104 is fixed at one end to the main casing 2 and engaged at the other end with the top end of the pressure plate 103. The pressure spring 104 urges the upper end of the pressure plate 103 to pivot toward the photosensitive drum 23.

The pivoting plate 105 is pivotably supported at its center on a shaft. The cam 106 includes a slender part 106*a* and a thick part 106*b*. The cam 106 pivots between the orientation indicated in solid line, wherein the slender part 106*a* contacts the lower end of the pivoting plate 105, and the orientation indicated in broken line, wherein the thick part 106*b* contacts the lower end of the pivoting plate. When a slender part 106*a* of the cam 106 is in contact the lower end of the pivoting plate 105, the top part of the pivoting plate 105 pivots toward the photosensitive drum 23 as indicated by the solid line. When a thick part 106*b* of the cam 106 is in contact with the lower end of the pivoting plate 105, then the upper end of the pivoting plate 105 pivots in the opposite direction as indicated by the dotted line.

The engaging part 102 is interposed between the pressure plate 103 and pivoting plate 105 when the developer cartridge 24 is mounted on the drum cartridge 22. During a developing process, a contacting/separating motor (not shown) operates to pivot the cam 106 into the solid-line orientation for bringing the slender part 106*a* into contact with the lower part of the pivoting plate 105. The urging force of the pressure spring 104 moves the engaging part 102, via the pressure plate 103, toward the photosensitive drum 23. As a result, the developer cartridge 24 is moved to a contact position such that the developing roller 41 contacts the photosensitive drum 23.

However, during a nondeveloping period, the contacting/separating motor (not shown) operates to pivot the cam 106 into the broken-line orientation for bringing the thick part 106*b* into contact with the lower part of the pivoting plate 105 against the urging force of the pressure spring 104. As a result, the engaging part 102 interposed between the pressure plate 103 and pivoting plate 105 moves away from the photosensitive drum 23, thereby moving the developer cartridge 24 to a separated position in which the developing roller 41 is separated from the photosensitive drum 23.

Figure 9:
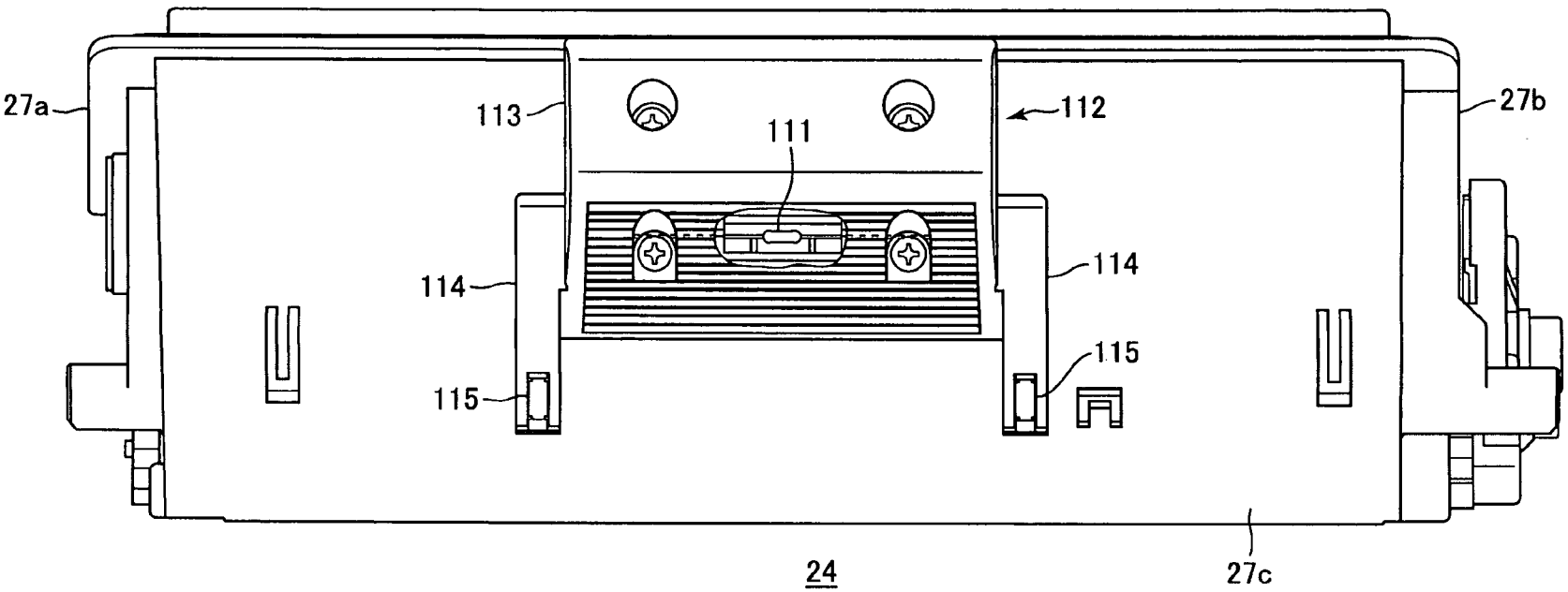
FIG. 9 is a rear view showing the developer cartridge with a portion removed to show a fuse.

As shown in FIGS. 2 and 9, a fuse 111 is mounted in the developer cartridge 24. The fuse 111 is for determining whether the developer cartridge 24 is new or old. The developer cartridge 24 is determined to have reached the end of its operating life not only when the remaining toner status is determined to be in an "empty state" but also in other situations such as when the developing roller 41 exceeds a stipulated number of rotations.

To determine the number of rotations of the developing roller 41, the CPU 91 counts the number of rotations of the developing roller 41 using an internal counter and stores this number in the NVRAM 96. When the number reaches the stipulated number of rotations, the developer cartridge 24 is determined to have reached the end of its operating life. A message indicating this determination is displayed on the display panel 93, and the driving of the main motor 97 is halted. The number of accumulated rotations of the developing roller 41 stored in the NVRAM 96 can be reset to zero by operating a certain key or keys on the control panel of the laser printer 1 or an external personal computer not shown in the drawings in order to input a reset signal. It should be noted that during execution of the main control program, the CPU 91 modifies the developing bias that is applied to the developing roller 41 according to the number of accumulated rotations of the developing roller 41 stored in the NVRAM 96.

When the developer cartridge 24 is replaced with a new cartridge, the remaining toner status is detected to be a "full state" so the developer cartridge 24 will not be considered to have reached the end of its usable life by this criteria alone. However, if the number of accumulated rotations of the developing roller 41 stored in the NVRAM 96 is not reset by operations of the user, then the there is a danger that the new developer cartridge 24 will be determined to have reached the end of its usable life prematurely. However, it is difficult to force the user to perform such a reset operation. Further, in some situations image formation cannot be performed if the resetting operation is forgotten.

According to the embodiment, the new/old status of the developer cartridge 24 in the laser printer 1 is determined based on whether electricity flows through the fuse 111. A reset signal is inputted automatically when the developer cartridge 24 is determined to be new.

As shown in FIG. 9, the fuse 111 is provided in a handle part 112 of the developing cartridge 24. The handle part 112 is disposed on a back wall 27*c* of the casing 27. The handle part 112 protrudes rearward from the back wall 27*c* and includes an integral main handle part 113 and leg units 114. The main handle part 113 has a rectangular shape when viewed from the back. The leg units 114 are disposed on either side of the main handle part 113. The fuse 111 is built into the main handle part 113 as shown in FIG. 9. Electrodes 115 are provided in the bottom end of each leg units 114. Each of the electrodes 115 has a substantially rectangular surface exposed in the lower part of the leg units 114. The electrodes 115 are connected to each other through the fuse 111.

The electrodes 115 contact a main casing electrode (not shown) provided on the main casing 2 side when the developer cartridge 24 is in the separation position and separate from the main casing electrode when the developer cartridge 23 is in the contact position. When the developer cartridge 24 is in a separated position, that is, during a nondeveloping period, the electrodes 115 conduct electricity through contact with the main casing electrodes. With this configuration, it is possible to determine whether the fuse 111 is blown or still continuous and to determine whether the developer cartridge 24 is new or old.

Figure 10:
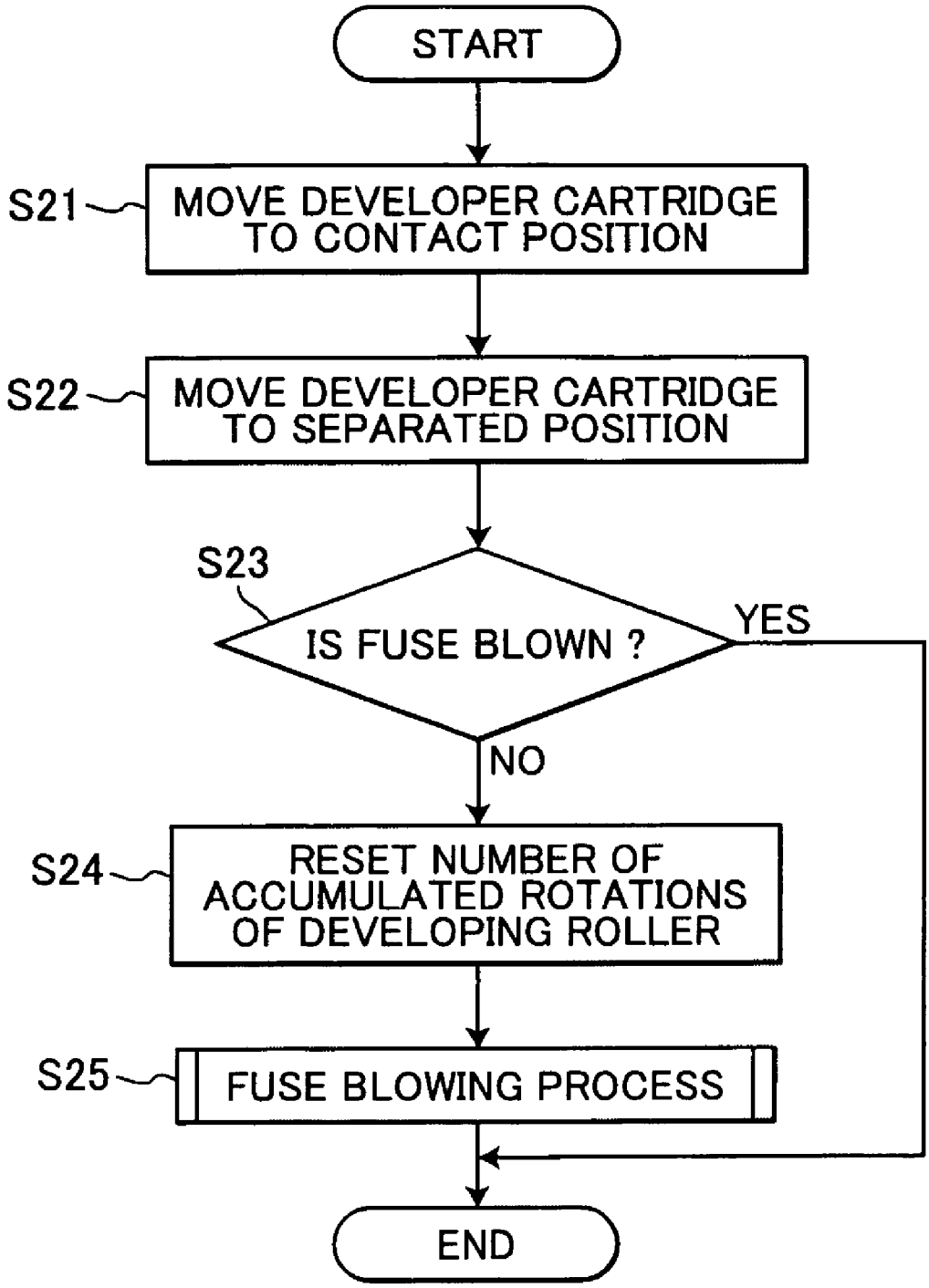
FIG. 10 is a flowchart representing processes of a new/old determining program.

Next, the processes of a new/old determining program for determining whether the developer cartridge 24 is now or old will be described with reference to FIG. 10.

As with the initial display program described above, the new/old determining program is started when the warm-up operation started in the main control program. In order to replace the developer cartridge 24, the top cover 53 must be opened and then closed. Therefore, the new/old status of the developer cartridge 24 can be determined at an optimal timing by starting the new/old determining program when the top cover 53 is opened and closed.

At the beginning of the new/old determining program, in S21 the developer cartridge 24 is moved to the contact position and subsequently in S22 the developer cartridge 24 is moved back to the separated position. When the developer cartridge 24 moves back into the separated position in S22, the electrodes 115 abut against to the main casing electrodes so that a proper electrical connection is established between the electrodes 115 and the main casing electrodes. Next, in S23 the CPU determines whether the fuse 111 has blown or not based on whether electricity flows through the fuse 111. If the fuse 111 is not blown (S23: NO), then it is determined that the developer cartridge 24 is a new one that was just installed. Therefore, in S24 the accumulated number of rotations of the developing roller 41 stored in the NVRAM 96 is reset. During the reset process, the number of accumulated rotations of the developing roller 41 and the developing bias are reset to initial values. In S25 the fuse 111 is blown by executing the process in a fuse blowing program.

Figure 11:
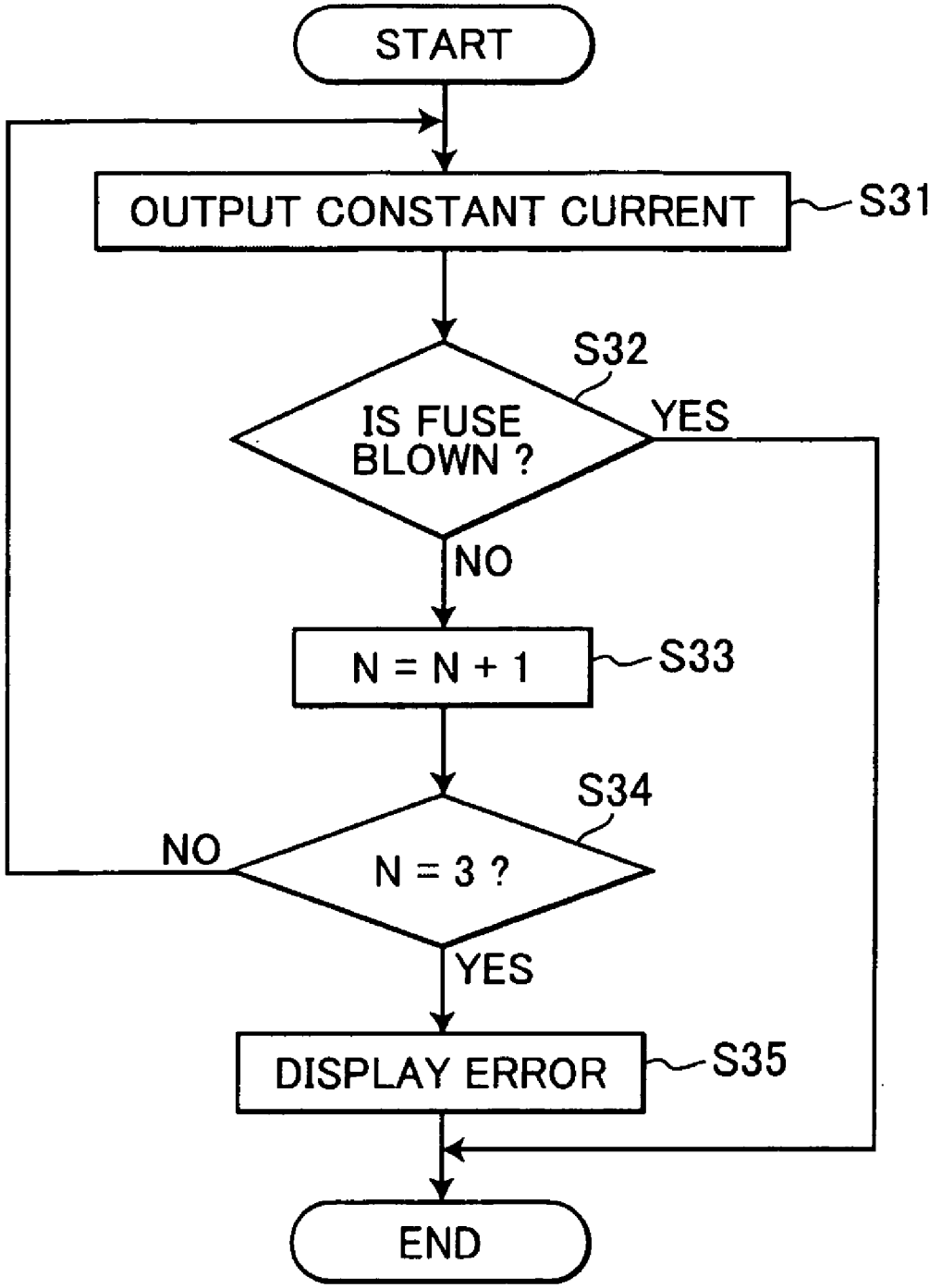
FIG. 11 is a flowchart representing processes of a fuse blowing program.

FIG. 11 is a flowchart that shows the steps in the process of the fuse blowing program. At the beginning of this process, a value N is reset to 0 and in S31 a constant current exceeding the rated current of the fuse 111 is outputted to the fuse 111. Next, the CPU refers to whether electricity is being conducted through the fuse 111 or not to determine in S32 whether the constant current blew the fuse 111. If the fuse 111 has blown (S32: YES), then the process of the fuse blowing program ends. However, if the fuse 111 has not blown (532: NO), then N is incremented by 1 in S33. In S34 the CPU determines whether N is equal to 3. While N is less than 3 (S34: NO), the steps of S31-S34 are repeated. If N is equal to 3 (S34: YES), this means that the fuse 111 has not been blown even after the constant current was outputted to the fuse 111 a total of three times. Therefore, in S35 an error message indicating that the fuse 111 has not blown is displayed on the display panel 93, and the fuse blowing program ends. Next, the new/old determining program also ends.

However, if the fuse 111 is determined in S23 of the new/old determining program to be already blown (S23: YES), then it is determined that no new developer cartridge 24 was installed in the laser printer 1 and the process of the new/old determining program ends.

By executing the new/old determining program, the laser printer 1 can automatically determine whether a new or old developer cartridge 24 is installed. The automatic determination requires only a simple construction. The user need not perform any special operations. Since the internal counter (number of accumulated rotations) is reset automatically, the developer cartridge 24 can be used properly up to the end of its operating life.

While the invention has been described in detail with reference to the specific embodiments thereof, it would be apparent to those skilled in the art that various changes and modifications may be made therein without departing from the spirit of the invention.

For example, the embodiment describes that the CPU 91 compares the remaining toner status that is detected during a warm-up operation with the remaining toner status that was detected during a normal operation situation and was stored in the NVRAM 96. The CPU 91 displays the larger of the two on the display panel 93. However, other types of calculations would enable the CPU 91 to precisely display the present amount of residual toner. For example, the CPU 91 can execute an averaging or a weighting operation based on the remaining toner status that is detected during the warm-up operation and on the remaining toner status that was detected during a normal operation situation and was stored in the NVRAM 96 and display the results of this operation on the display panel 93.

What is claimed is:

1. An image forming device comprising:

a developer container that accommodates developer;

a developer amount detector that detects a remaining developer amount accommodated in the developer container;

a display;

a memory that stores data representing a remaining developer amount detected by the developer amount detector; and a controller that performs a warm-up operation and that, during the warm-up operation, performs a calculation based on the remaining developer amount detected by the developer amount detector and on the data stored in the memory and controls to display a status of the remaining developer amount on the display based on results of the calculation, wherein:

the calculation performed by the controller includes comparing the remaining developer amount detected by the developer amount detector during the warm-up operation with the remaining developer amount indicated by the data stored in the memory; and the controller controls to display a larger of the remaining developer amount detected by the developer amount detector during the warm-up operation and the remaining developer amount indicated by the data stored in the memory.

2. The image forming device as claimed in claim 1, further comprising:

an image forming unit that, under control of the controller, forms images using developer from the developer container; and an agitator provided in the developer container, the agitator agitating the developer accommodated in the developer container, wherein during the warm-up operation the controller controls to drive the agitator and does not control the image forming unit to form images.

3. The image forming device as claimed in claim 1, further comprising an image forming unit that forms images using developer from the developer container, wherein the controller, while the image forming unit is forming an image, controls to display the status of the remaining developer amount detected by the developer amount detector and not to display the status of the remaining developer amount indicated by the data stored in the memory.

4. The image forming device as claimed in claim 1, wherein the controller determines the status of the remaining developer amount and controls to display the determined status, the controller determining the status of the remaining developer amount as one of:

a full state when the developer container is substantially filled with developer, an empty state when the developer container accommodates substantially no remaining developer, and a low state when the developer container accommodates less remaining developer than in the full state and more remaining developer than in the empty state.

5. The image forming device as claimed in claim 1, wherein, before performing the warm-up operation, the controller controls the display to display a remaining developer amount detected by the developer amount detector before the warm-up operation, the data stored by memory representing the remaining developer amount that was displayed on the display based on the detection by the developer amount detector before the warm-up operation.

6. The image forming device as claimed in claim 1, wherein the developer container accommodates developer that is substantially spherical toner particles.

7. The image forming device as claimed in claim 1, wherein the developer amount detector includes a light-emitting element and a light-receiving element, the light-receiving element and the light-emitting element being disposed facing each other with the developer container interposed therebetween, the developer amount detector detecting the remaining developer amount in the developer container based on a ratio of light emitted from the light-emitting element to light received by the light-receiving element.

8. The image forming device as claimed in claim 7, wherein the developer container comprises:

a light-transmissive window that enables light emitted from the light-emitting element to be received by the light-receiving element; and a cleaner that cleans the light-transmissive window.

9. The image forming device as claimed in claim 1, wherein the calculation performed by the controller includes performing a weighting operation on the remaining developer amount detected by the developer amount detector and the remaining developer amount indicated by the data stored in the memory.

10. The image forming device as claimed in claim 1, wherein the calculation performed by the controller includes performing an averaging operation on the remaining developer amount detected by the developer amount detector and the remaining developer amount indicated by the data stored in the memory.

11. The image forming device as claimed in claim 1, further comprising:

an image forming unit that, under control of the controller, forms images using developer from the developer container; and a power unit that supplies power to the image forming unit when turned on, the controller performing the warm-up operation as a result of the power unit being turned on.

12. The image forming device as claimed in claim 1, further comprising:

a usage determiner that determines an amount of usage of the developer container and stores data in the memory that represents the amount of usage; and a new developer container determination unit that determines whether the developer container is new, the controller performing the warm-up operation and resetting the data in the memory that represents the amount of usage when the new developer container determination unit determines that the developer container is new.

13. The image forming device as claimed in claim 1, further comprising an image forming unit that, under control of the controller, forms images using developer from the developer container, the controller setting the image forming unit into a sleep mode under predetermined conditions and, under other predetermined conditions, releasing the image forming unit from the sleep mode and performing the warm-up operation.

14. The image forming device as claimed in claim 1, further comprising:

a housing that houses the developer container;

a cover provided in the housing, the cover being openable for accessing the developer container;

a open/close detection unit that detects when the cover is opened and closed, the controller performing the warm-up operation when the open/close detection unit detects that the cover has been opened and closed.

15. The image forming device as claimed in claim 1, wherein the data stored in the memory represents the remaining developer amount detected by the developer amount detector before the warm-up operation.

16. An image forming device for forming a developer image on a recording medium, the image forming device comprising:

a developer container that accommodates developer;

a developer amount detector that detects a remaining developer amount accommodated in the developer container;

a display;

a memory that stores data representing a remaining developer amount detected by the developer amount detector; and a controller that compares the remaining developer amount detected by the developer amount detector with the remaining developer amount indicated by the data stored in the memory and that controls to display a larger of the remaining developer amount detected by the developer amount detector and the remaining developer amount indicated by the data stored in the memory.

* * * * *